US011396024B2

(12) United States Patent
Gui et al.

(10) Patent No.: US 11,396,024 B2
(45) Date of Patent: Jul. 26, 2022

(54) UNDERGROUND COAL SEPARATION PROCESS

(71) Applicant: CHINA UNIVERSITY OF MINING AND TECHNOLOGY, Jiangsu (CN)

(72) Inventors: Xiahui Gui, Jiangsu (CN); Min Liu, Jiangsu (CN); Yaowen Xing, Jiangsu (CN); Yangchao Xia, Jiangsu (CN); Yijun Cao, Jiangsu (CN); Jiaqian Luo, Jiangsu (CN); Peikun Liu, Shandong (CN); Zhigang Wang, Beijing (CN)

(73) Assignee: CHINA UNIVERSITY OF MINING AND TECHNOLOGY, Jiangsu (CN)

( * ) Notice: Subject to any disclaimer, the term of this patent is extended or adjusted under 35 U.S.C. 154(b) by 0 days.

(21) Appl. No.: 17/059,476

(22) PCT Filed: Apr. 22, 2019

(86) PCT No.: PCT/CN2019/083665
§ 371 (c)(1),
(2) Date: Nov. 30, 2020

(87) PCT Pub. No.: WO2020/181618
PCT Pub. Date: Sep. 17, 2020

(65) Prior Publication Data

US 2021/0162427 A1 Jun. 3, 2021

(30) Foreign Application Priority Data

Mar. 8, 2019 (CN) ..... 201910174675.0

(51) Int. Cl.
*B03B 9/00* (2006.01)
*B03B 7/00* (2006.01)
*B03B 5/10* (2006.01)

(52) U.S. Cl.
CPC ..... *B03B 9/005* (2013.01); *B03B 7/00* (2013.01); *B03B 5/10* (2013.01)

(58) Field of Classification Search
CPC ..... B03B 5/10; B03B 7/00; B03B 9/005
See application file for complete search history.

(56) References Cited

U.S. PATENT DOCUMENTS 4,175,035 A * 11/1979 Moyer, Jr. ..... B03B 9/005 209/10
4,778,219 A * 10/1988 Wilczynski ..... B03B 5/18 299/8

(Continued)

FOREIGN PATENT DOCUMENTS

CN 1883812 12/2006
CN 105126991 12/2015

(Continued)

OTHER PUBLICATIONS

"International Search Report (Form PCT/ISA/210)" of PCT/CN2019/083665, dated Dec. 5, 2019, with English translation thereof, pp. 1-4.

(Continued)

*Primary Examiner* — Michael McCullough
*Assistant Examiner* — Kalyanavenkateshware Kumar
(74) *Attorney, Agent, or Firm* — JCIP Global Inc.

(57) ABSTRACT

Disclosed is an underground coal preparation process adopting a water medium, comprising: feeding exploited raw coal into a Φ25 mm raw coal classifying screen for screening; performing dry coal preparation on a classifying screen oversize product with a particle size greater than 25 mm and feeding a classifying screen undersize product with a particle size less than 25 mm into a special underground compact jigging machine for sorting to obtain jigging machine overflow clean coal, jigging middling coal and jigging gangue; screening and dewatering the jigging (Continued)

machine overflow clean coal to obtain a clean coal product, and screening and dewatering the jigging middling coal to obtain a middling coal product, sorting slime water to be sorted and generated during sorting to obtain coarse clean coal slime and coarse middling coal slime, and performing circulating water treatment on a final liquid.

4 Claims, 2 Drawing Sheets

(56) References Cited

U.S. PATENT DOCUMENTS

| | | | | |
|---|---|---|---|---|
| 5,794,791 | A * | 8/1998 | Kindig | B03B 5/34<br>209/12.1 |
| 2013/0061516 | A1* | 3/2013 | Zhang | B03B 5/18<br>44/280 |

FOREIGN PATENT DOCUMENTS

| | | |
|---|---|---|
| CN | 105772212 | 7/2016 |
| DE | 3006911 | 9/1981 |

OTHER PUBLICATIONS

"Written Opinion of the International Searching Authority (Form PCT/ISA/237)" of PCT/CN2019/083665, dated Dec. 5, 2019, pp. 1-4.

* cited by examiner

UNDERGROUND COAL SEPARATION PROCESS

CROSS-REFERENCE TO RELATED APPLICATION

This application is a 371 of international application of PCT application serial no. PCT/CN2019/083665, filed on Apr. 22, 2019, which claims the priority benefit of China application no. 201910174675.0, filed on Mar. 8, 2019. The entirety of each of the above mentioned patent applications is hereby incorporated by reference herein and made a part of this specification.

TECHNICAL FIELD

The present invention relates to an underground coal separation process, and in particular, to an underground coal separation process using dry-wet combined coal separation, applicable to the field of coal separation.

BACKGROUND

An existing underground coal separation method includes dry coal preparation represented by wind coal separation and heavy medium fluidized bed coal separation as well as wet coal preparation represented by jigging coal separation and heavy medium cyclone coal separation. The two coal separation methods have their own advantages and disadvantages: the dry coal preparation, taking air or an air heavy medium as a separation medium, has the advantages of saving a large amount of water resources, reducing equipment investment and energy consumption, having high efficiency and environmental friendliness and simplifying separation process flow, and has the disadvantages of strong dependence on environmental stability, relatively high on the water content of raw coal and high separation particle size lower limit; the wet coal preparation, tanking water and heavy medium suspension liquid as separation mediums, has the advantages of high separation precision, low separation particle size lower limit and mature technology, and is the most widely used coal separation method; and the wet coal preparation has the disadvantages of high consumption of heavy medium, rapid wear of pipelines and equipment, generation of a large amount of coal slime water which is the most important problem, large quantity of circulating water, difficulty in treatment, high pressure to the surrounding environment and difficulty in control. At present, overground coal separation is dominated by the wet method, and the on-site application effect of dry coal preparation is poor, so that the built dry coal preparation process is idle or changed, and dry coal preparation is applied to gangue predischarging in most cases.

SUMMARY OF THE INVENTION

For the defects in the prior art, the present invention provides an underground coal separation process, which is capable of completely exerting the technical advantages of dry and wet coal preparation, is high in separation efficiency and is scientific and environmentally-friendly.

To achieve the above technical object, the present invention provides an underground coal separation process adopting a water medium, including the following steps:

feeding an exploited raw coal into a Φ25 mm raw coal classifying screen A by a raw coal feeding chute T for screening to obtain a classifying screen oversize product with a particle size greater than 25 mm and a classifying screen undersize product with a particle size less than 25 mm;

feeding the classifying screen oversize product with a particle size greater than 25 mm into a TDS intelligent dry separator B to perform dry coal preparation, and performing separation to respectively obtain dry separation clean coal and dry separation gangue to be discharged;

feeding the classifying screen undersize product with a particle size less than 25 mm into a special underground compact jigging machine C for separation to obtain jigging machine overflow clean coal, jigging middling coal and jigging gangue, and directly discharging the jigging gangue; due to high water content of the jigging machine overflow clean coal, feeding the jigging machine overflow clean coal into a fixed screen D for predewatering to obtain a clean coal fixed screen oversize product and undersize water, feeding the undersize water into a coal slime pool I, feeding the clean coal fixed screen oversize product into a Φ13 mm classifying screen for screening to obtain oversize block clean coal with a particle size greater than 13 mm and undersize clean coal with a particle size less than 13 mm, discharging the oversize block clean coal with a particle size greater than 13 mm serving as a clean coal product, feeding the undersize clean coal with a particle size less than 13 mm into a clean coal centrifugal dewatering machine G for dewatering to obtain centrifugal dewatering machine clean coal and centrifugate I, discharging the centrifugal dewatering machine clean coal serving as a clean coal product, and feeding the centrifugate I into the coal slime pool I; feeding the jigging middling coal into a Φ13 mm classifying screen F for separation to obtain oversize middling coal with a particle size greater than 13 mm and undersize middling coal with a particle size less than 13 mm, discharging the oversize middling coal with a particle size greater than 13 mm directly serving as a middling coal product without further dewatering, feeding the undersize middling coal with a particle size less than 13 mm into a middling coal centrifugal dewatering machine H for dewatering to obtain dewatered middling coal and centrifugate II, discharging the dewatered middling coal serving as a middling coal product, and feeding the centrifugate II into the coal slime pool I;

mixing the undersize water, the centrifugate I and the centrifugate II in the coal slime pool I to form to-be-separated coal slime water containing coarse coal slime, feeding the to-be-separated coal slime water containing coarse coal slime into a water medium classifying and separation cyclone J by a slurry pump U, after separation, performing first-section classification by the water medium classifying and separation cyclone J to obtain overflow, enabling cyclone first-section underflow to enter second-section separation to obtain overflow containing coarse clean coal slime and underflow containing coarse middling coal slime, feeding the overflow into a stirring barrel P for stirring, adding a coal slime water treatment medicament which is a sedimentation-promoting medicament such as a flocculating agent, a coagulating agent and the like into the stirring barrel P by a medicament adding box 0, completely mixing the overflow and the coal slime water treatment medicament in the stirring barrel P to obtain coal slime water, feeding the coal slime water into a roadway high-efficiency concentrator Q to perform sedimentation, discharging concentrator underflow from an outlet at the bottom of the roadway high-efficiency concentrator Q after sedimentation, feeding the concentrator underflow into a coal slime filter press R to perform filter pressing and dewatering to respectively discharge coal slime and filter press filtrate, discharging the filter press filtrate into a clarifying pool S, discharging concentrator overflow from an outlet above the concentrator Q and feeding the concentrator overflow into the clarifying pool S; feeding the overflow containing coarse clean coal slime into a coarse clean coal sieve bend L for screening and feeding the underflow containing coarse middling coal slime into a coarse middling coal sieve bend K for screening to generate coarse clean coal sieve bend undersize water and coarse middling coal sieve bend undersize water respectively, feeding the coarse clean coal sieve bend undersize water and the coarse middling coal sieve bend undersize water into the coal slime pool I again, feeding a coarse clean coal sieve bend oversize product of the coarse clean coal sieve bend L and a coarse middling coal sieve bend oversize product of the coarse middling coal sieve bend K into a coarse clean coal slime centrifugal dewatering machine N and a coarse middling coal slime centrifugal dewatering machine M respectively for dewatering to finally generate coarse clean coal slime, coarse middling coal slime, centrifugate IV and centrifugate III, and feeding the centrifugate IV and the centrifugate III into the coal slime pool I to continuously circulate.

Circulating water generated in the clarifying pool S is fed into the special underground compact jigging machine C by a clean water pump V for use.

The model of the special underground compact jigging machine C is JYT-J series, the model of the roadway high-efficiency concentrator Q is YT-N series, and the specific model parameters are determined according to the field process requirements.

The dry separation gangue and the jigging gangue serving as backfill materials directly fill underground without going up to the well, thereby reducing environmental pollution.

Beneficial Effects:

According to the present invention, through combined use of dry coal preparation and wet coal preparation, large materials with a particle size greater than 25 mm are separated by a TDS intelligent dry separator, materials with a particle size less than 25 mm are separated by the jigging and water medium cyclone, and the water entering quantity of the raw coal is reduced, thus reducing the sliming phenomenon of the raw coal; a heavy medium separation process is not used, thereby avoiding heavy medium loss caused by the heavy medium coal separation process, reducing production cost and equipment investment and simplifying process flow; no flotation underground may save underground space and reduce energy consumption of the equipment; and a flotation medicament is avoided, thus effectively reducing the dangerousness of underground production and improving underground production environment;

by adoption of the special underground compact jigging machine, the equipment treatment capacity is high, the equipment structure and size are suitable for a narrow space and the separation ability of the raw coal may be ensured; the water medium classifying and separation cyclone consists of two sections, the first-section cylindrical structure plays a role in accurate classification, the second-section cylindrical-conical structure plays a role in accurate classification, the equipment simplifies the complicated overground coarse coal slime recovery process, the clean coal and middling coal after separation of the raw coal are transported to the well, and the gangue serves as the underground filling raw material, thus reducing useless energy consumption caused by gangue transportation, ground-surface environmental pollution and the influence of coal mining on the stability of the underground rock stratum.

BRIEF DESCRIPTION OF THE DRAWINGS

In FIG. 1, 1—raw coal, 2—classifying screen oversize product with a particle size greater than 25 mm, 3—classifying screen oversize product with a particle size less than 25 mm, 4—TDS intelligent dry separator clean coal, 5—dry separation gangue, 6—jigging machine overflow clean coal, 7—jigging middling coal, 8—jigging gangue, 9—clean coal fixed screen oversize product, 10—undersize water (10), 11—block clean coal with a particle size greater than 13 mm, 12—undersize clean coal with a particle size less than 13 mm, 13—an oversize middling coal with a particle size greater than 13 mm, 14—undersize middling coal with a particle size less than 13 mm, 15—centrifugal dewatering machine clean coal, 16—centrifugate I, 17—dewatering middling coal, 18—centrifugate II, 19—to-be-separated coal slime water, 20—underflow containing coarse middling coal slime, 21—overflow containing coarse clean coal slime, 22—overflow, 23—coarse middling coal slime sieve bend oversize product, 24—coarse middling coal slime arc-shaped sieve bend undersize water, 25—coarse clean coal slime sieve bend oversize product, 26—coarse clean coal slime sieve bend undersize water, 27—coal slime centrifugal dewatering machine coarse middling coal slime, 28—coal slime centrifugal dewatering machine centrifugate, 29—coal slime centrifugal dewatering machine coarse clean coal slime, 30—coal slime centrifugal dewatering machine centrifugate, 31—coal slime water treatment medicament, 32—coal slime water, 33—concentrator underflow, 34—concentrator overflow water, 35—coal slime, 36—filter press filtrate, 37—circulating water.

DETAILED DESCRIPTION OF THE EMBODIMENTS

The specific implementations of the present invention are further described below in detail with reference to the accompanying drawings.

Figure 1:
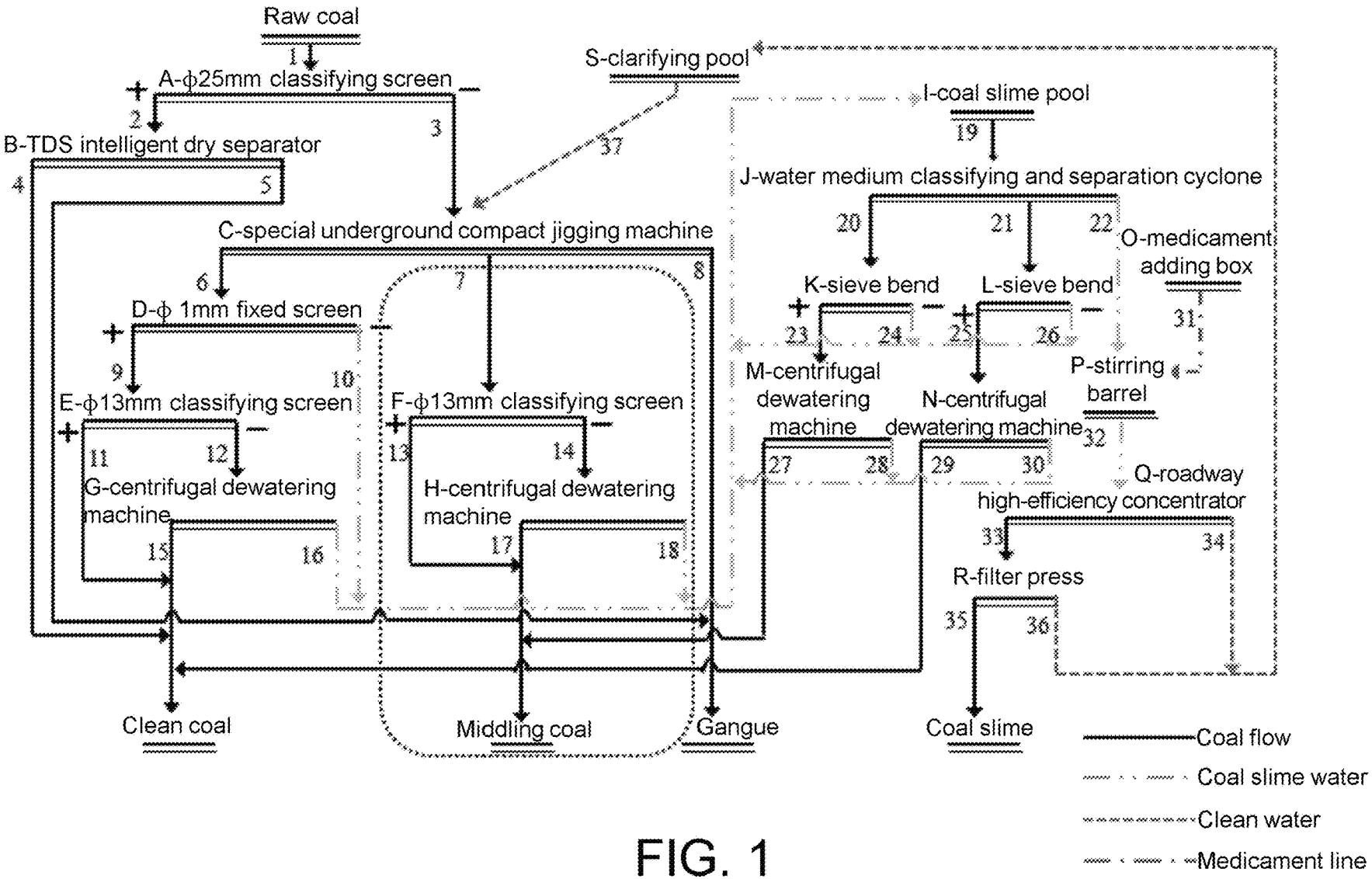
FIG. 1 is a process flow diagram of the present invention.
Figure 2:
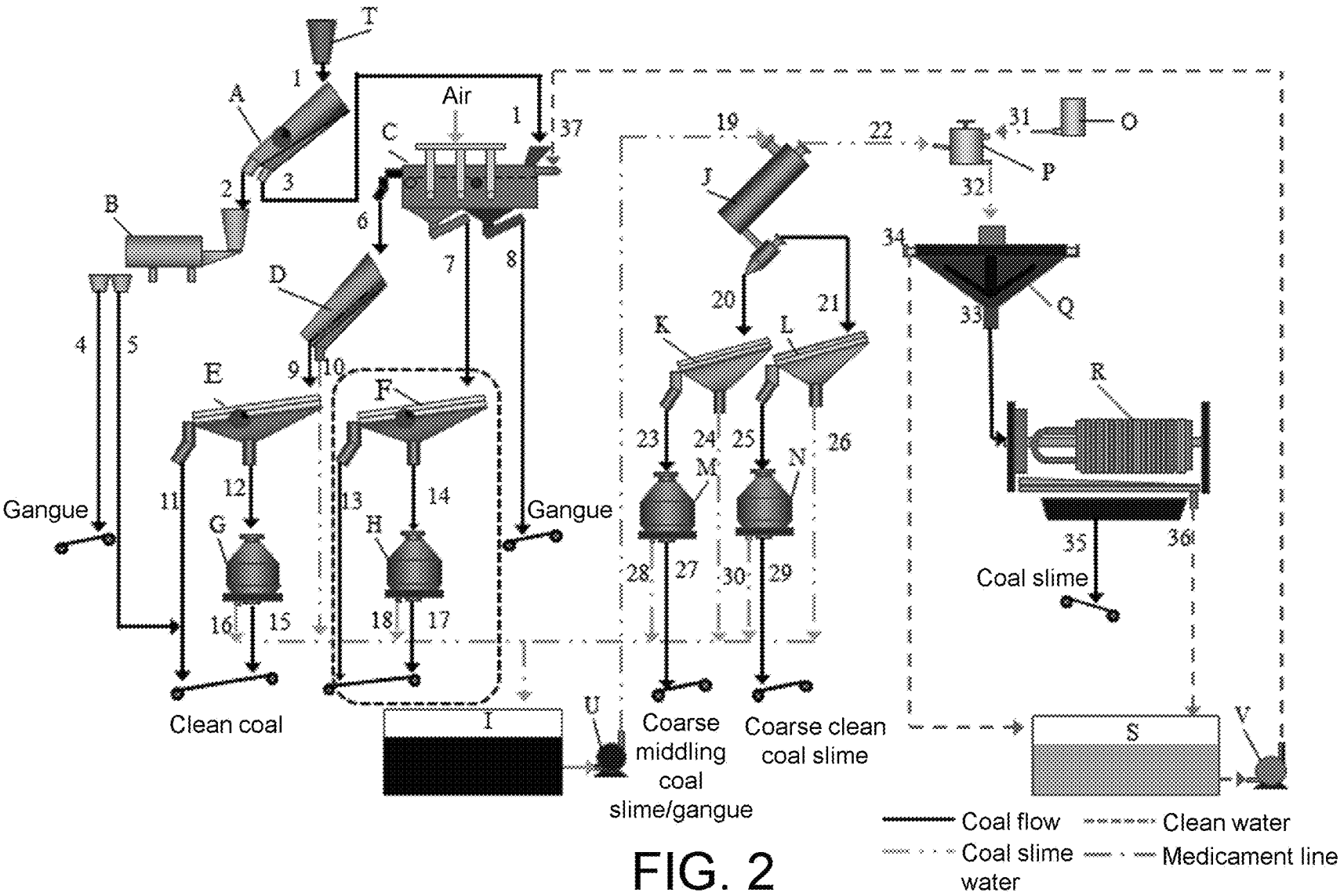
FIG. 2 is a structural diagram of equipment according to the present invention.

As shown in FIG. 1 and FIG. 2, the underground coal separation process adopting a water medium according to the present invention includes the following steps:

exploited raw coal 1 is fed into a Φ25 mm raw coal classifying screen A by a raw coal feeding chute T for screening to obtain a classifying screen oversize product 2 with a particle size greater than 25 mm and a classifying screen undersize product 3 with a particle size less than 25 mm;

the classifying screen oversize product 2 with a particle size greater than 25 mm is fed into a TDS intelligent dry separator B to perform dry coal preparation, and separation is conducted to respectively obtain dry separation clean coal 4 and dry separation gangue 5 to be discharged;

the classifying screen undersize product 3 with a particle size less than 25 mm is fed into a special underground compact jigging machine C for separation to obtain jigging machine overflow clean coal 6, jigging middling coal 7 and jigging gangue 8, and the jigging gangue 8 is directly discharged; due to high water content of the jigging machine overflow clean coal 6, the jigging machine overflow clean coal 6 is fed into a fixed screen D for predewatering to obtain a clean coal fixed screen oversize product 9 and undersize water 10 which is Φ1 mm clean coal fixed screen undersize water, the undersize water 10 is fed into a coal slime pool I, the clean coal fixed screen oversize product 9 is fed into a Φ13 mm classifying screen for screening to obtain oversize block clean coal 11 with a particle size greater than 13 mm and undersize clean coal 12 with a particle size less than 13 mm, the oversize block clean coal 11 with a particle size greater than 13 mm serving as a clean coal product is discharged, the undersize clean coal 12 with a particle size less than 13 mm is fed into a clean coal centrifugal dewatering machine G for dewatering to obtain centrifugal dewatering machine clean coal 15 and centrifugate I 16, the centrifugal dewatering machine clean coal 15 serving as a clean coal product is discharged, and feeding the centrifugate I 16 is fed into the coal slime pool I; the jigging middling coal 7 is fed into a Φ13 mm classifying screen F for separation to obtain oversize middling coal 13 with a particle size greater than 13 mm and undersize middling coal 14 with a particle size less than 13 mm, the oversize middling coal 13 with a particle size greater than 13 mm directly serving as a middling coal product is discharged without further dewatering, the undersize middling coal 14 with a particle size less than 13 mm is fed into a middling coal centrifugal dewatering machine H for dewatering to obtain dewatered middling coal 17 and centrifugate II 18, the dewatered middling coal 17 serving as a middling coal product is discharged, and the centrifugate II 18 is fed into the coal slime pool I; and the undersize water 10, the centrifugate I 16 and the centrifugate II 18 are mixed in the coal slime pool I to form to-be-separated coal slime water 19 containing coarse coal slime, the to-be-separated coal slime water 19 containing coarse coal slime is fed into a water medium classifying and separation cyclone J by a slurry pump U, after separation, first-section classification is conducted by the water medium classifying and separation cyclone J to obtain overflow 22, cyclone first-section underflow enters second-section separation to obtain overflow 21 containing coarse clean coal slime and underflow 20 containing coarse middling coal slime, the overflow 22 is fed into a stirring barrel P for stirring, a coal slime water treatment medicament 31 which is a sedimentation-promoting medicament such as a flocculating agent, a coagulating agent and the like is added into the stirring barrel P by a medicament adding box 0, the overflow 22 and the coal slime water treatment medicament 31 are completely mixed in the stirring barrel P to obtain coal slime water 32, the coal slime water 32 is fed into a roadway high-efficiency concentrator Q to perform sedimentation, concentrator underflow 33 is discharged from an outlet at the bottom of the roadway high-efficiency concentrator Q after sedimentation, the concentrator underflow 33 is fed into a coal slime filter press R to perform filter pressing and dewatering to respectively discharge coal slime 35 and filter press filtrate 36, the filter press filtrate 36 is discharged into a clarifying pool S, concentrator overflow 34 is discharged from an outlet above the concentrator Q and the concentrator overflow 34 is fed into the clarifying pool S; the overflow 21 containing coarse clean coal slime is fed into a coarse clean coal sieve bend L for screening and the underflow 20 containing coarse middling coal slime is fed into a coarse middling coal sieve bend K for screening to generate coarse clean coal sieve bend undersize water 26 and coarse middling coal sieve bend undersize water 24 respectively, the coarse clean coal sieve bend undersize water 26 and the coarse middling coal sieve bend undersize water 24 is fed into the coal slime pool I again, a coarse clean coal sieve bend oversize product 26 of the coarse clean coal sieve bend L and a coarse middling coal sieve bend oversize product 23 of the coarse middling coal sieve bend K are fed into a coarse clean coal slime centrifugal dewatering machine N and a coarse middling coal slime centrifugal dewatering machine M respectively for dewatering to finally generate coarse clean coal slime 29, coarse middling coal slime 27, centrifugate IV 30 and centrifugate III 28, and the centrifugate IV 30 and the centrifugate III 28 is fed into the coal slime pool I to continuously circulate. Circulating water 37 is generated in the clarifying pool S and is fed into the special underground compact jigging machine C by a clean water pump V for use. The model of the special underground compact jigging machine C is JYT-J series, the model of the roadway high-efficiency concentrator Q is YT-N series, and the specific model parameters are determined according to the field process requirements. The dry separation gangue 5 and the jigging gangue serving as backfill materials 8 are directly filled underground without going up to the well, thereby reducing environmental pollution.

What is claimed is:

1. An underground coal separation process adopting a water medium, comprising following steps:

feeding an exploited raw coal into a Φ25 mm raw coal classifying screen by a raw coal feeding chute for screening to obtain a classifying screen oversize product with a particle size greater than 25 mm and a classifying screen undersize product with a particle size less than 25 mm;

feeding the classifying screen oversize product with a particle size greater than 25 mm into a TDS intelligent dry separator to perform a dry coal preparation, and separating to respectively obtain a dry separation clean coal and a dry separation gangue to be discharged;

feeding the classifying screen undersize product with a particle size less than 25 mm into a special underground compact jigging machine for separation to obtain a jigging machine overflow clean coal, a jigging middling coal and a jigging gangue, and directly discharging the jigging gangue; due to a high water content of the jigging machine overflow clean coal, feeding the jigging machine overflow clean coal into a fixed screen for predewatering to obtain a clean coal fixed screen oversize product and an undersize water which is Φ1 mm clean coal fixed screen undersize water, feeding the undersize water into a first coal slime pool, feeding the clean coal fixed screen oversize product into a Φ13 mm classifying screen for screening to obtain an oversize block clean coal with a particle size greater than 13 mm and an undersize clean coal with a particle size less than 13 mm, discharging the oversize block clean coal with a particle size greater than 13 mm serving as a clean coal product, feeding the undersize clean coal with a particle size less than 13 mm into a clean coal centrifugal dewatering machine for dewatering to obtain a centrifugal dewatering machine clean coal and a first centrifugate, discharging the centrifugal dewatering machine clean coal serving as a clean coal product, and feeding the first centrifugate into the first coal slime pool; feeding the jigging middling coal into a Φ13 mm classifying screen for separation to obtain oversize middling coal with a particle size greater than 13 mm and undersize middling coal with a particle size less than 13 mm, discharging the oversize middling coal with a particle size greater than 13 mm directly serving as a middling coal product without further dewatering, feeding the undersize middling coal with a particle size less than 13 mm into a middling coal centrifugal dewatering machine for dewatering to obtain a dewatered middling coal and a second centrifugate, discharging the dewatered middling coal serving as a middling coal product, and feeding the second centrifugate into the first coal slime pool; and mixing the undersize water, the first centrifugate and the second centrifugate in the first coal slime pool to form a to-be-separated coal slime water containing coarse coal slime, feeding the to-be-separated coal slime water containing coarse coal slime into a water medium classifying and separation cyclone by a slurry pump, after separation, performing a first-section classification by the water medium classifying and separation cyclone to obtain an overflow, enabling cyclone a first-section underflow to enter a second-section separation to obtain an overflow containing coarse clean coal slime and an underflow containing coarse middling coal slime, feeding the overflow into a stirring barrel for stirring, adding a coal slime water treatment medicament which is a sedimentation-promoting medicament into the stirring barrel by a medicament adding box, completely mixing the overflow and the coal slime water treatment medicament in the stirring barrel to obtain coal slime water, feeding the coal slime water into a roadway high-efficiency concentrator to perform sedimentation, discharging a concentrator underflow from an outlet at the bottom of the roadway high-efficiency concentrator after sedimentation, feeding the concentrator underflow into a coal slime filter press to perform filter pressing and dewatering to respectively discharge a coal slime and a filter press filtrate, discharging the filter press filtrate into a clarifying pool, discharging a concentrator overflow from an outlet above the concentrator and feeding the concentrator overflow into the clarifying pool; feeding the overflow containing coarse clean coal slime into a coarse clean coal sieve bend for screening and feeding the underflow containing coarse middling coal slime into a coarse middling coal sieve bend for screening to generate a coarse clean coal sieve bend undersize water and a coarse middling coal sieve bend undersize water respectively, feeding the coarse clean coal sieve bend undersize water and the coarse middling coal sieve bend undersize water into the first coal slime pool again, feeding the coarse clean coal sieve bend oversize product of the coarse clean coal sieve bend and a coarse middling coal sieve bend oversize product of the coarse middling coal sieve bend into a coarse clean coal slime centrifugal dewatering machine and a coarse middling coal slime centrifugal dewatering machine respectively for dewatering to finally generate a coarse clean coal slime, a coarse middling coal slime, a third centrifugate and a fourth centrifugate, and feeding the third centrifugate and the fourth centrifugate into the first coal slime pool to continuously circulate.

2. The underground coal separation process adopting a water medium according to claim 1, wherein a circulating water is generated in the clarifying pool and is fed into the special underground compact jigging machine by a clean water pump for use.

3. The underground coal separation process adopting a water medium according to claim 1, wherein a model of the special underground compact jigging machine is JYT-J series, a model of the roadway high-efficiency concentrator is YT-N series, and specific model parameters are determined according to a field process requirements.

4. The underground coal separation process adopting a water medium according to claim 1, wherein the dry separation gangue and the jigging gangue serving as backfill materials directly fill an underground without going up to a well, thereby reducing an environmental pollution.

* * * * *